US011600457B2

(12) United States Patent
Fan et al.

(10) Patent No.: US 11,600,457 B2
(45) Date of Patent: Mar. 7, 2023

(54) BUTTON SWITCH

(71) Applicant: Yongkang Chuangxing Technology Co., LTD, Jinhua (CN)

(72) Inventors: Wenyi Fan, Yongkang (CN); Shuhua Men, Yongcheng (CN)

( * ) Notice: Subject to any disclaimer, the term of this patent is extended or adjusted under 35 U.S.C. 154(b) by 0 days.

(21) Appl. No.: 17/455,665

(22) Filed: Nov. 18, 2021

(65) Prior Publication Data

US 2022/0076905 A1 Mar. 10, 2022

(30) Foreign Application Priority Data

Nov. 23, 2020 (CN) ..... 202022725572.X

(51) Int. Cl.
*H01H 13/28* (2006.01)
*H01H 13/56* (2006.01)

(52) U.S. Cl.
CPC ..... *H01H 13/56* (2013.01); *H01H 13/28* (2013.01)

(58) Field of Classification Search
CPC ..... H01H 13/56; H01H 13/28; H01H 13/22; H01H 3/001; H01H 1/50; H01H 13/36; H01H 13/20; H01H 3/125; H01H 13/705; H01H 13/14; H01H 13/04; H01H 13/10; H01H 13/70; H01H 13/704; H01H 13/7065; H01H 13/7006; H01H 13/7057; H01H 13/78; H01H 13/79; H01H 13/52; H01H 13/703; H01H 13/507; H01H 3/12
See application file for complete search history.

(56) References Cited

U.S. PATENT DOCUMENTS

| | | | | |
|---|---|---|---|---|
| 6,864,453 | B1 * | 3/2005 | Yu | H01H 73/26 200/520 |
| 7,932,475 | B2 * | 4/2011 | Schnodt | H01H 5/24 200/461 |
| 2010/0290163 | A1 * | 11/2010 | Li | H01H 83/04 361/42 |
| 2012/0222943 | A1 | 9/2012 | Chenier | |
| 2012/0268035 | A1 | 10/2012 | Stanley | |
| 2014/0262718 | A1 | 9/2014 | Chuang | |
| 2014/0321006 | A1 * | 10/2014 | Huang | H02H 3/162 361/49 |

* cited by examiner

*Primary Examiner* — Ahmed M Saeed
(74) *Attorney, Agent, or Firm* — Rumit R. Kanakia

(57) ABSTRACT

The present disclosure belongs to the technical field of switches, and particularly relates to a button switch. The button switch comprises a base, an upper cover plate and a lower cover plate are arranged on the upper side and the lower side of the base respectively, a circuit board is arranged in the base, input wiring terminals and output insertion pieces are connected to the circuit board, a switch assembly for controlling the communication of the input wiring terminals and the output insertion pieces is arranged between the input wiring terminals and the output insertion pieces The button switch is stable in use process, stable in contact, long in service life, not prone to damage and convenient to maintain, and can be widely applied to various handheld electric tools.

10 Claims, 8 Drawing Sheets

DRAWINGS

BUTTON SWITCH

TECHNICAL FIELD

The present disclosure belongs to the technical field of switches, and particularly relates to a button switch.

BACKGROUND

Such button switches currently on the market have substantially similar functions, but suffer from the following functional defects:

firstly, a common button switch is only internally provided with a simple seesaw structure, and the structure determines that the switch cannot realize a power-off restart protection function; in the normal use process of an electric tool, if power is suddenly cut off and a user forgets to unlock the locking device of the electric tool, the electric tool is still running when the power is on, danger easily occurs, the GB15092 national safety standard is not met, and great potential safety hazards exist for human life;

secondly, the internal structure of the button switch with similar functions is of a multi-layer structure, glue needs to be smeared repeatedly to bond the multi-layer structure in the production process, the production process is complex, and the production efficiency is low; and thirdly, the other type is that a circuit board is additionally arranged on a common button switch to realize a power-off protection function, so that internal flat cables are disordered, the internal space of the electric tool needs to be enlarged, the structure of an existing electric tool product needs to be adjusted greatly, and the cost is high.

Therefore, the button switch with the power-off protection function, which is the same in size, compact in structure and simple in process, is urgently required to be designed.

SUMMARY

The present disclosure aims to provide a button switch which is compact in structure and high in service life.

The purpose of the present disclosure is realized as follows:

The button switch comprises a base, an upper cover plate and a lower cover plate are arranged on the upper side and the lower side of the base respectively, a circuit board is arranged in the base, input wiring terminals and output insertion pieces are connected to the circuit board, a switch assembly for controlling the communication of the input wiring terminals and the output insertion pieces is arranged between the input wiring terminals and the output insertion pieces, the switch assembly comprises a contact frame communicating with the input wiring terminals and a static contact piece communicating with the output insertion pieces, a movable springboard is arranged between the contact frame and the static contact piece, one end of the springboard is connected to the contact frame through a hook spring, the other end of the springboard is located above the static contact piece, when the other end of the springboard is in contact with the static contact piece, the input wiring terminals communicate with the output insertion pieces, the base further comprises a button, the lower end of the button is located at the middle section of the hook spring, and the upper end of the button extends out of the upper cover body.

In the present disclosure, further, a button fixed middle cover is arranged in the middle of the button to ensure the up-and-down movement flexibility of the button, and a reset spring is arranged below the button.

In the present disclosure, further, a first contact is arranged on the springboard, a second contact is arranged on the static contact piece, and when the springboard bounces downwards, the first contact is in contact with the second contact, so that electric communication between the input wiring terminals and the output insertion pieces is achieved.

In the present disclosure, further, a limiting pin is arranged above the springboard.

In the present disclosure, the circuit board is provided with two groups of input wiring terminals and output insertion pieces, and the two groups of input wiring terminals and output insertion pieces are correspondingly connected with each other.

In the present disclosure, further, a screw hole is formed in the input wiring terminal, and the screw hole is internally provided with a wire pressing screw.

In the present disclosure, further, a safety capacitor is installed on the circuit board.

In the present disclosure, further, a silicon controlled rectifier and a 3P terminal are arranged on the circuit board.

In the present disclosure, further, a buckle is formed on the side edge of the base, the upper cover plate is covered with a cooling fin, mounting clamping holes are formed in the two sides of the cooling fin, and the cooling fin is fixed to the buckle of the base through the mounting clamping holes.

In the present disclosure, further, button holes for the button to pass through are formed in the upper cover plate and the cooling fin, and a dustproof ring is arranged at the button holes.

Compared with the prior art, the present disclosure has the following outstanding and beneficial effects:

The present disclosure is a button switch which is compact in structural design, stable in use process, stable in contact, long in service life, not prone to damage, convenient to maintain and capable of being widely applied to various handheld electric tools. According to the specific structure, a switch body is composed of a base, an upper cover plate and a lower cover plate, a circuit board is installed in the switch body, input wiring terminals and output insertion pieces are connected to the circuit board and used for connecting a circuit, a switch assembly for controlling on and off of the circuit is further installed in the switch body, the switch button comprises a contact frame communicating with the input wiring terminals and a static contact piece communicating with the output insertion pieces, and when the contact frame is in contact or indirect contact with the static contact piece, communication of the circuit can be completed. According to the structure, an elastic springboard is arranged between the contact frame and the static contact piece, one end of the springboard abuts against the contact frame, one end of the hook spring is hooked in the middle of the springboard, the other end of the hook spring is hooked on the contact frame, and the lower end of the button is located in the middle of the hook spring, and when the button is pressed, the lower end of the button pushes the middle section of the hook spring. Due to the fact that the contact frame is fixed, the hook spring can drive the springboard connected with the hook spring to move downwards, so that the springboard is in contact with the static contact piece, and communication of the circuit is completed. The structure is clear and simple, and correspondingly, the service life is also long.

REFERENCE SIGNS

Figure 1:
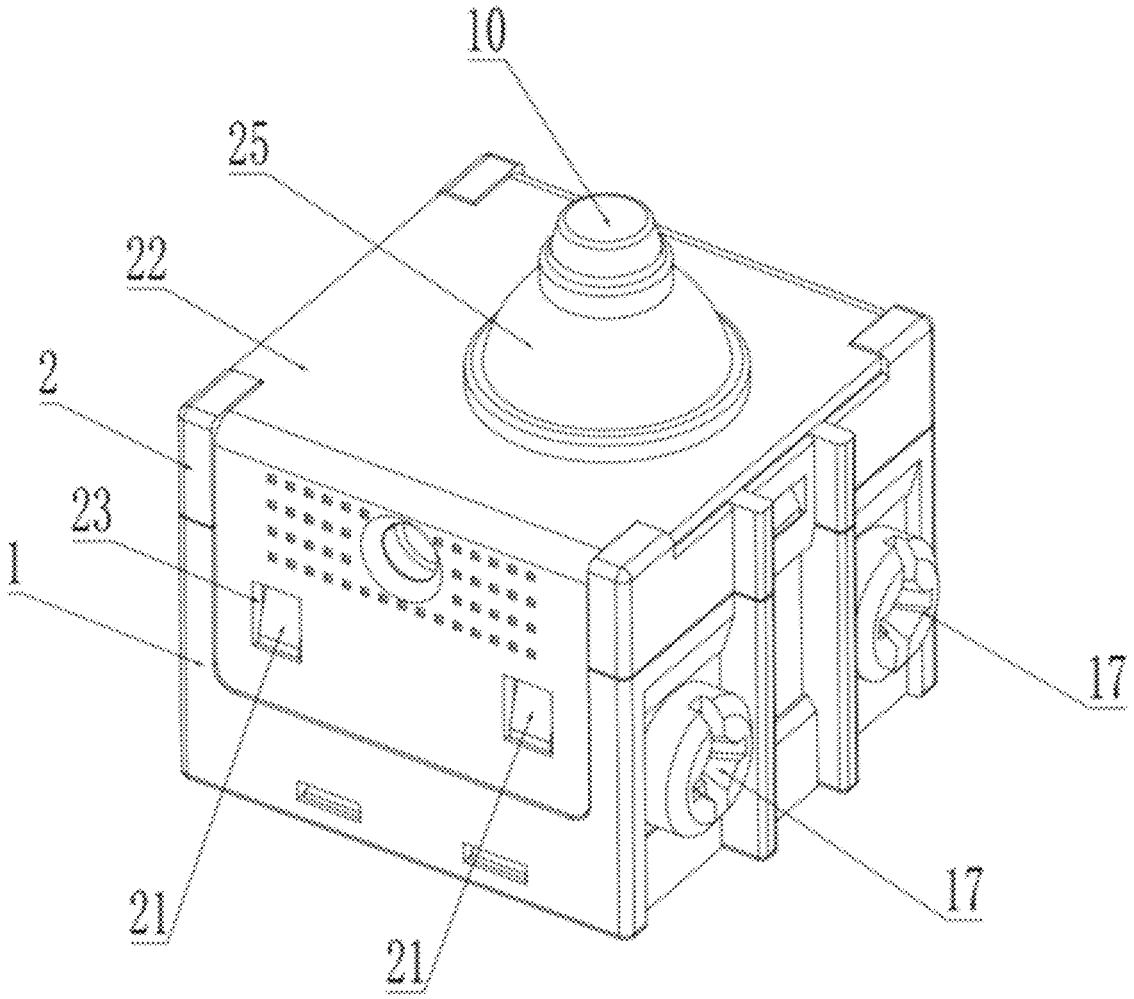
FIG. 1 is a structural schematic diagram of the present disclosure.
Figure 2:
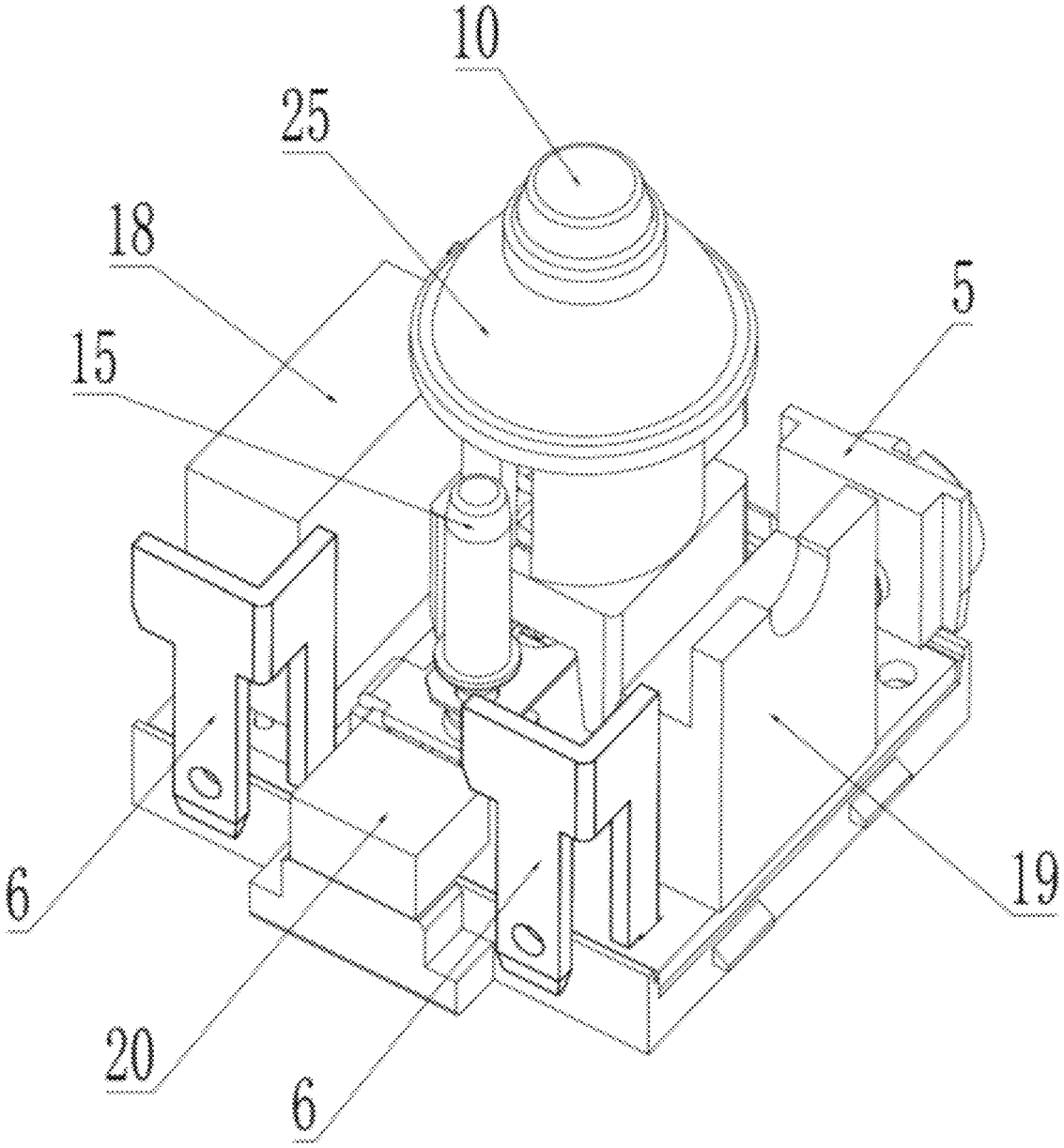
FIG. 2 is a structural schematic diagram of the interior of the present disclosure.
Figure 3:
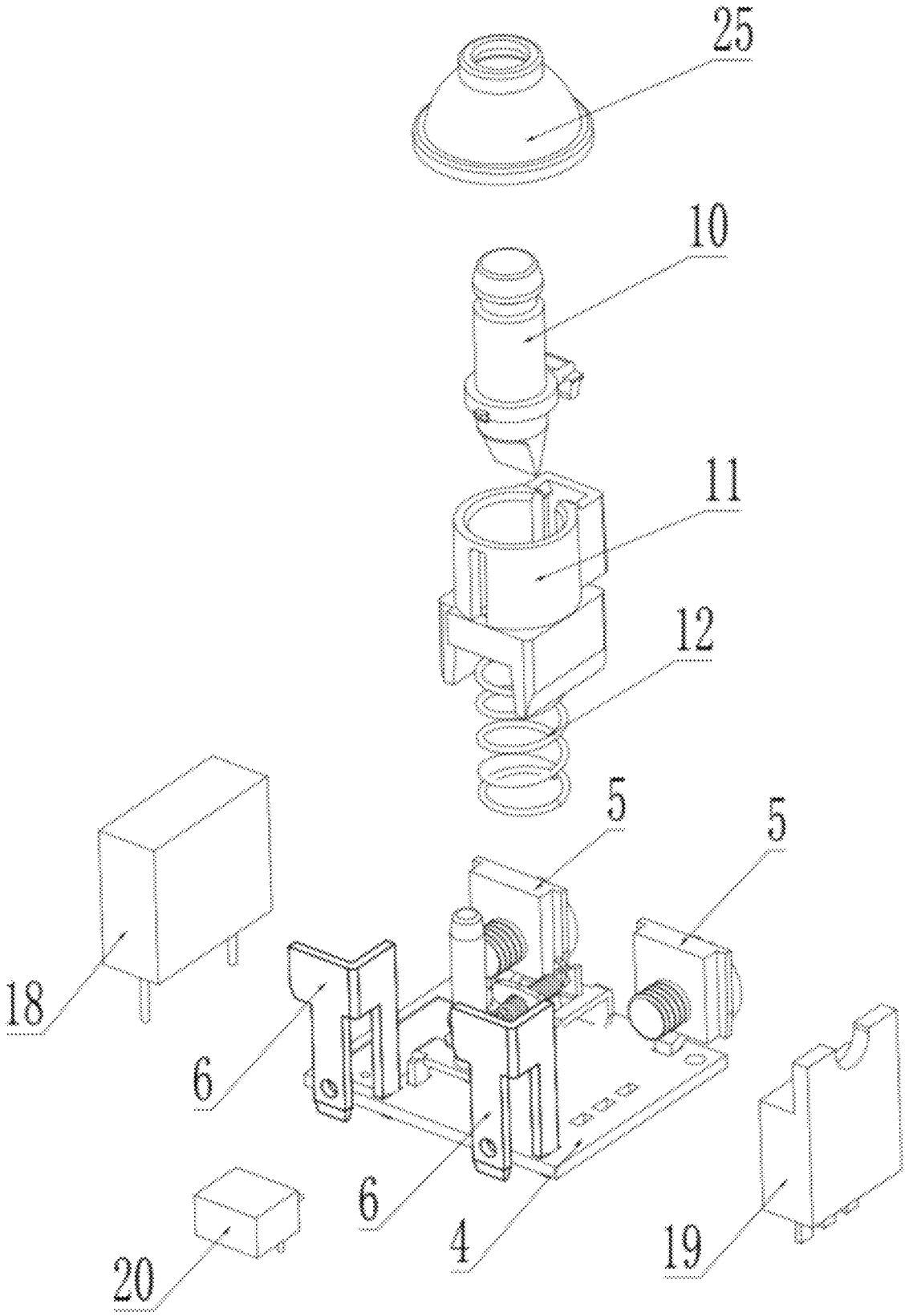
FIG. 3 is a structural explosive view of FIG. 2.
Figure 4:
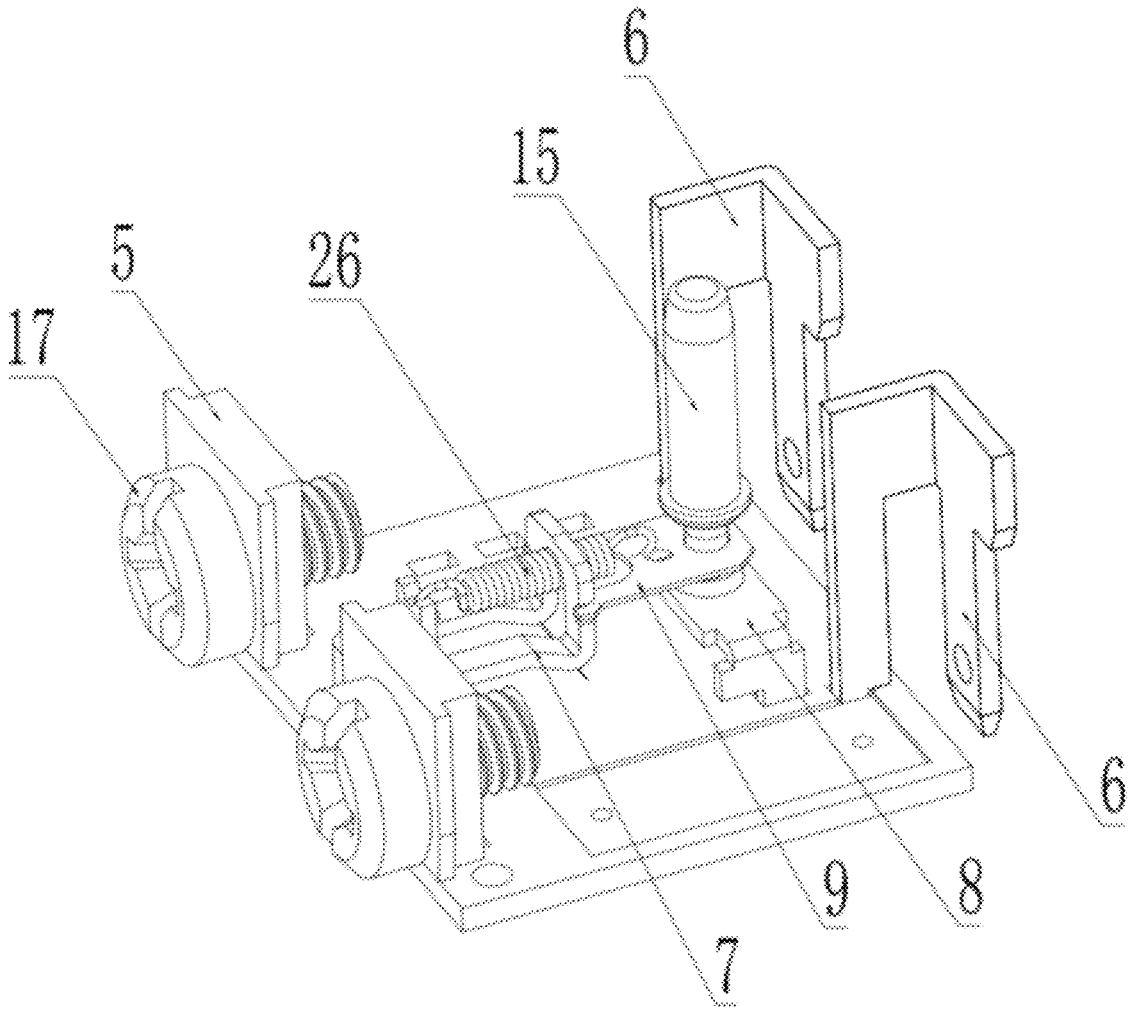
FIG. 4 is a structural schematic diagram of a circuit board in the present disclosure.
Figure 5:
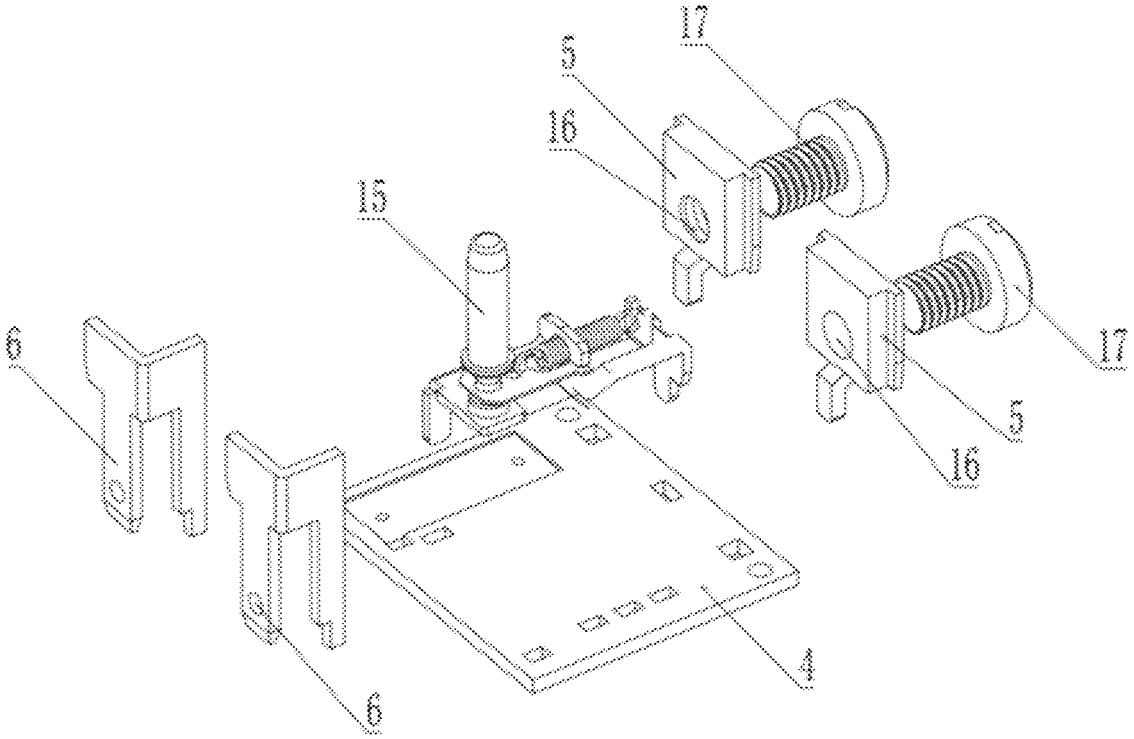
FIG. 5 is a structural explosive view of FIG. 4.
Figure 6:
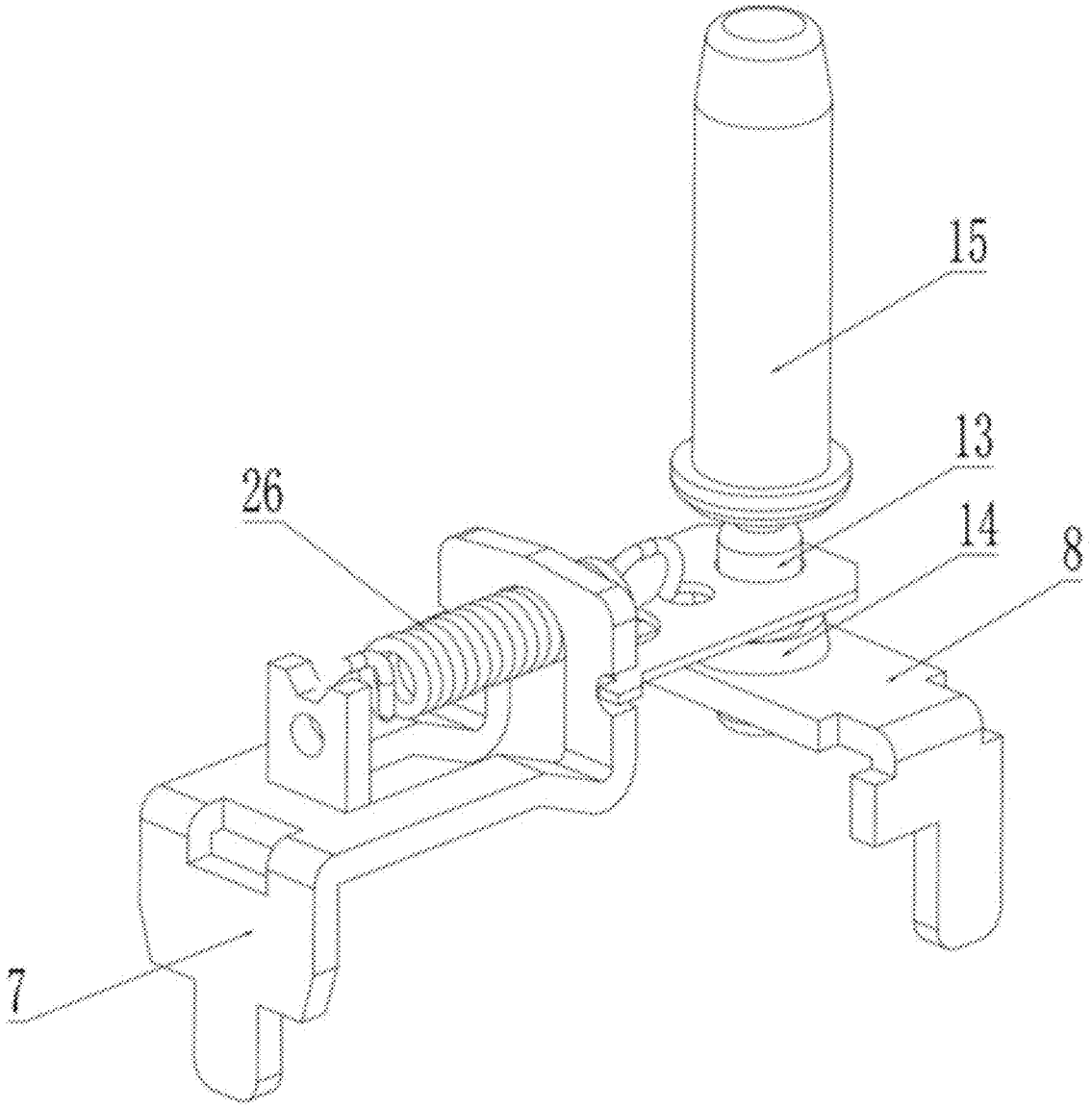
FIG. 6 is a structural schematic diagram of a switch assembly in the present disclosure.
Figure 7:
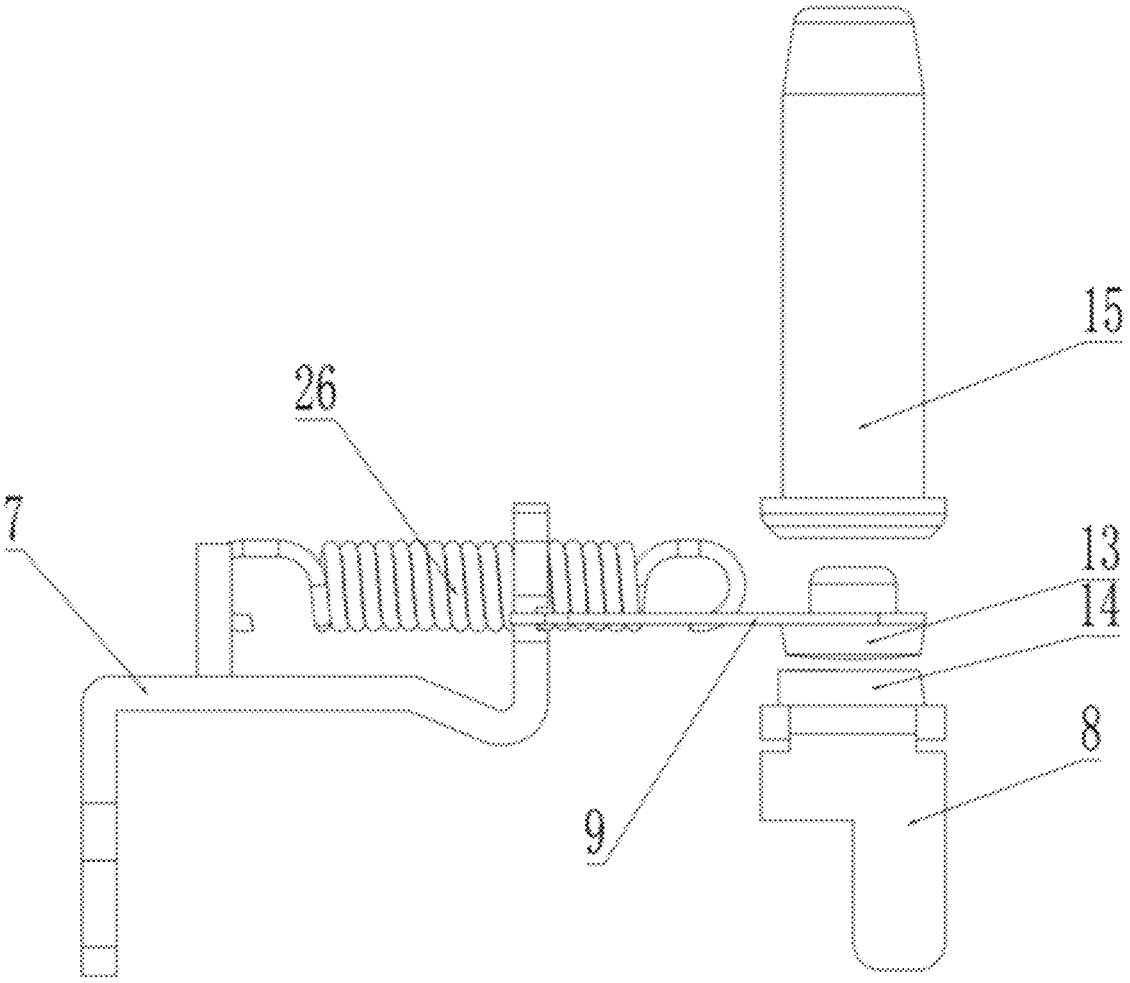
FIG. 7 is a side view of a switch assembly in the present disclosure.
Figure 8:
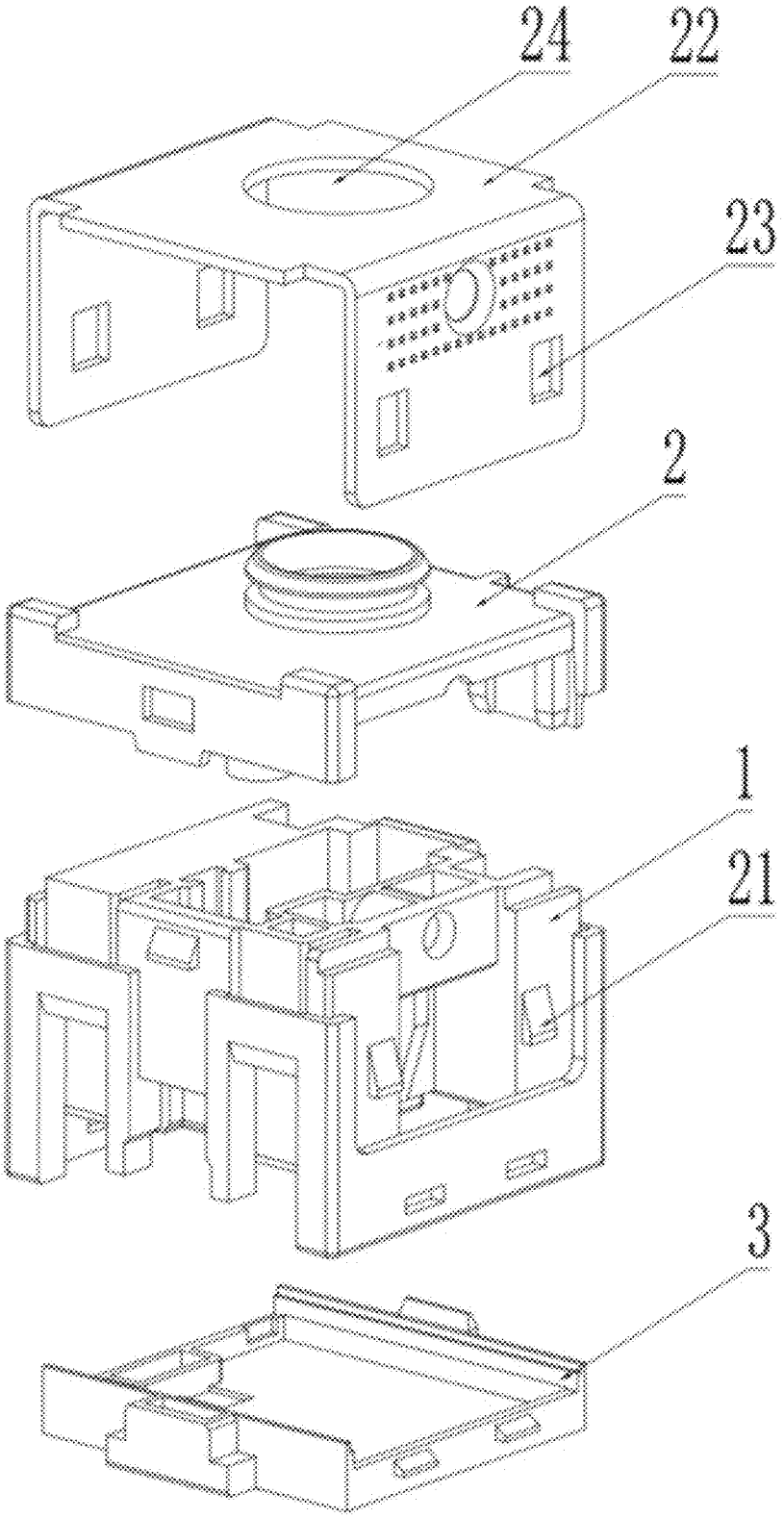
FIG. 8 is an explosive view of a switch body in the present disclosure.

1, base; 2, upper cover plate; 3, lower cover plate; 4, circuit board; 5, input wiring terminal; 6, output insertion piece; 7, contact frame; 8, static contact piece; 9, springboard; 10, button; 11, button fixed middle cover; 12, reset spring; 13, first contact; 14, second contact; 15, limiting pin; 16, screw hole; 17, wire pressing screw; 18, safety capacitor; 19, silicon controlled rectifier; 20, 3P terminal; 21, buckle; 22, cooling fin; 23, mounting clamping hole; 24, button hole; 25, dustproof ring; and 26, hook spring.

DETAILED DESCRIPTION OF THE EMBODIMENTS

The description of the present disclosure is further described in conjunction with the following specific embodiments.

A button switch comprises a base 1, an upper cover plate 2 and a lower cover plate 3 are arranged on the upper side and the lower side of the base 1 respectively, a circuit board 4 is arranged in the base 1, input wiring terminals 5 and output insertion pieces 6 are connected to the circuit board 4, a switch assembly for controlling the communication of the input wiring terminals 5 and the output insertion pieces 6 is arranged between the input wiring terminals 5 and the output insertion pieces 6, the switch assembly comprises a contact frame 7 communicating with the input wiring terminals 5 and a static contact piece 8 communicating with the output insertion pieces 6, a movable springboard 9 is arranged between the contact frame 7 and the static contact piece 8, one end of the springboard 9 is connected to the contact frame 7 through a hook spring 26, the other end of the springboard 9 is located above the static contact piece 8, when the other end of the springboard 9 is in contact with the static contact piece 8, the input wiring terminals 5 communicate with the output insertion pieces 6, the base 1 further comprises a button 10, the lower end of the button 10 is located at the middle section of the hook spring 26, and the upper end of the button 10 extends out of the upper cover body.

The present disclosure is a button switch which is compact in structural design, stable in use process, stable in contact, long in service life, not prone to damage, convenient to maintain and capable of being widely applied to various handheld electric tools. According to the specific structure, a switch body is composed of a base 1, an upper cover plate 2 and a lower cover plate 3, a circuit board 4 is installed in the switch body, input wiring terminals 5 and output insertion pieces 6 are connected to the circuit board 4 and used for connecting a circuit, a switch assembly for controlling on and off of the circuit is further installed in the switch body, the switch button comprises a contact frame 7 communicating with the input wiring terminals 5 and a static contact piece 8 communicating with the output insertion pieces 6, and when the contact frame 7 is in contact or indirect contact with the static contact piece 8, communication of the circuit can be completed. According to the structure, an elastic springboard 9 is arranged between the contact frame 7 and the static contact piece 8, one end of the springboard 9 abuts against the contact frame 7, one end of the hook spring 26 is hooked in the middle of the springboard 9, the other end of the hook spring 26 is hooked on the contact frame 7, and the lower end of the button 10 is located in the middle of the hook spring 26, and when the button 10 is pressed, the lower end of the button 10 pushes the middle section of the hook spring 26. Due to the fact that the contact frame 7 is fixed, the hook spring 26 can drive the springboard 9 connected with the hook spring 26 to move downwards, so that the springboard 9 is in contact with the static contact piece 8, and communication of the circuit is completed. The structure is clear and simple, and correspondingly, the service life is also long.

As a preferred embodiment of the present disclosure, a button fixed middle cover 11 is arranged in the middle of the button 10 to ensure the up-and-down movement flexibility of the button, and a reset spring 12 is arranged below the button 10. The reset spring 12 is used for driving the button 10 to reset, and after the button 10 is loosened, the automatic reset function of the button 10 is completed through the reset spring 12.

As a preferred embodiment of the present disclosure, a first contact 13 is arranged on the springboard 9, a second contact 14 is arranged on the static contact piece 8, and when the springboard 9 bounces downwards, the first contact 13 is in contact with the second contact 14, so that electric communication between the input wiring terminals 5 and the output insertion pieces 6 is achieved. The contact is arranged at the contact point of the springboard 9 and the static contact piece 8, so that the contact stability is ensured, and the connection is not easy to break without reason under normal conditions.

As a preferred embodiment of the present disclosure, a limiting pin 15 is arranged above the springboard 9. The limiting pin 15 is located above the first contact 13, when the switch is switched off, the hook spring 26 drives the springboard 9 to move upwards, in order to prevent the springboard 9 from moving over large distance, limiting is conducted through the limiting pin 15, heat is generated because the contacts are in contact and electrified, and when the contacts are switched off, the first contact 13 is in contact with the limiting pin 15 made of metal, and the heat dissipation effect can be achieved.

As a preferred embodiment of the present disclosure, the circuit board 4 is provided with two groups of input wiring terminals 5 and output insertion pieces 6, and the two groups of input wiring terminals 5 and output insertion pieces 6 are correspondingly connected with each other.

As a preferred embodiment of the present disclosure, a screw hole 16 is formed in the input wiring terminal 5, and the screw hole 16 is internally provided with a wire pressing screw 17. An input wire is fixed through the wire pressing screws 17 and is not easy to fall off.

As a preferred embodiment of the present disclosure, a safety capacitor 18 is arranged on the circuit board 4. Due to the space problem of the switch, the conventional safety capacitor 18 is generally externally connected to the outside of the switch through a circuit, is not beautiful, is very inconvenient to use and is easy to damage, and the safety capacitor 18 is arranged in the present disclosure, so that the problem that the conventional safety capacitor 18 is not beautiful, inconvenient to use and the like is solved. The assembly space and assembly time are saved, and the resource waste is reduced.

As a preferred embodiment of the present disclosure, a silicon controlled rectifier 19 and a 3P terminal 20 are arranged on the circuit board 4. The silicon controlled rectifier 19 is used for controlling the circuit, and the 3P terminal 20 is a quick plug-in terminal and can be externally connected with a knob lead.

As a preferred embodiment of the present disclosure, a buckle 21 is formed on the side edge of the base 1, the upper cover plate 2 is covered with a cooling fin 22, mounting clamping holes 23 are formed in the two sides of the cooling fin 22, and the cooling fin 22 is fixed to the buckle 21 of the base 1 through the mounting clamping holes 23. The cooling fin 22 is more convenient to mount, the coverage is large, and the cooling effect is good.

As a preferred embodiment of the present disclosure, button holes 24 for the button 10 to pass through are formed in the upper cover plate 2 and the cooling fin 22, and a dustproof ring 25 is arranged at the button holes 24. The dustproof ring is used for preventing dust or other substances from entering the switch to affect the normal service life of the switch.

The above embodiment is only a better embodiment of the present disclosure, and does not limit the protection range of the present disclosure, so that equivalent changes made according to the structure, shape and principle of the present disclosure should be covered in the protection range of the present disclosure.

What is claimed is:

1. A button switch, comprising a base, an upper cover plate and a lower cover plate being arranged on the upper side and the lower side of the base respectively, a circuit board being arranged in the base, input wiring terminals and output insertion pieces being connected to the circuit board, and a switch assembly for controlling the communication of the input wiring terminals and the output insertion pieces being arranged between the input wiring terminals and the output insertion pieces, wherein the switch assembly comprises a contact frame communicating with the input wiring terminals and a static contact piece communicating with the output insertion pieces, a movable springboard is arranged between the contact frame and the static contact piece, one end of the springboard is connected to the contact frame through a hook spring, the other end of the springboard is located above the static contact piece, when the other end of the springboard is in contact with the static contact piece, the input wiring terminals communicate with the output insertion pieces, the base further comprises a button, the lower end of the button is located at the middle section of the hook spring, and the upper end of the button extends out of the upper cover body.

2. The button switch according to claim 1, wherein a button fixed middle cover is arranged in the middle of the button, and a reset spring is arranged below the button.

3. The button switch according to claim 1, wherein a first contact is arranged on the springboard, a second contact is arranged on the static contact piece, and when the springboard bounces downwards, the first contact is in contact with the second contact, so that electric communication between the input wiring terminals and the output insertion pieces is achieved.

4. The button switch according to claim 3, wherein a limiting pin is arranged above the springboard.

5. The button switch according to claim 1, wherein the circuit board is provided with two groups of input wiring terminals and output insertion pieces, and the two groups of input wiring terminals and output insertion pieces are correspondingly connected with each other.

6. The button switch according to claim 5, wherein a screw hole is formed in the input wiring terminal, and the screw hole is internally provided with a wire pressing screw.

7. The button switch according to claim 1, wherein a safety capacitor is installed on the circuit board.

8. The button switch according to claim 1, wherein a silicon controlled rectifier and a 3P terminal are arranged on the circuit board.

9. The button switch according to claim 1, wherein a buckle is formed on the side edge of the base, the upper cover plate is covered with a cooling fin, mounting clamping holes are formed in the two sides of the cooling fin, and the cooling fin is fixed to the buckle of the base through the mounting clamping holes.

10. The button switch according to claim 9, wherein button holes for the button to pass through are formed in the upper cover plate and the cooling fin, and a dustproof ring is arranged at the button holes.

* * * * *